US010571215B2

(12) United States Patent
Swor

(10) Patent No.: US 10,571,215 B2
(45) Date of Patent: Feb. 25, 2020

(54) WATER SPRAY SYSTEM FOR A BOAT

(71) Applicant: Loren Swor, Duncan, OK (US)

(72) Inventor: Loren Swor, Duncan, OK (US)

( * ) Notice: Subject to any disclaimer, the term of this patent is extended or adjusted under 35 U.S.C. 154(b) by 30 days.

(21) Appl. No.: 15/951,839

(22) Filed: Apr. 12, 2018

(65) Prior Publication Data

US 2018/0299226 A1 Oct. 18, 2018

Related U.S. Application Data

(60) Provisional application No. 62/484,697, filed on Apr. 12, 2017.

(51) Int. Cl.
*F41B 9/00* (2006.01)
*B63B 35/85* (2006.01)
(Continued)

(52) U.S. Cl.
CPC ..... *F41B 9/0053* (2013.01); *B63B 17/0018* (2013.01); *B63B 35/85* (2013.01);
(Continued)

(58) Field of Classification Search
CPC ..... B63B 35/00; B63B 35/14; B63B 35/26; B63B 35/85; B63B 17/00; B63B 17/0018; B63H 11/00; B63H 11/10; B63H 11/107; B63H 20/00; B63H 20/36; B01F 3/04; A01K 63/04; F41B 9/00; F41B 9/0018; F41B 9/0053
(Continued)

(56) References Cited

U.S. PATENT DOCUMENTS 3,139,060 A * 6/1964 Dane ..... A01M 7/0082 440/39
4,033,280 A 7/1977 Wood et al.
(Continued)

FOREIGN PATENT DOCUMENTS

GB 2 371 241 7/2002

OTHER PUBLICATIONS

James, Roger, "Unifire AB Releases Two New Videos of Force 50 Robotic Nozzles." Published by Piratesafe.com on Nov. 4, 2015. Retrieved from the Internet at http://piratesafe.com/monitors/unifireabreleasestwonewvideosofforce50roboticnozzles/ on Feb. 22, 2017.
(Continued)

*Primary Examiner* — Lars A Olson
(74) *Attorney, Agent, or Firm* — Dunlap Codding, P.C.

(57) ABSTRACT

A water intake system for a boat spray gun, including a system utilizing a port through a transom of a boat, the port positioned proximate to the bottom portion of the boat; a spray gun system; and a water intake system, comprising: a first water inlet tube having a proximal end connectable to a pump of the spray gun system and a distal end connectable to a swivel; a second water inlet tube having a proximal end and a distal end, the proximal end connectable to the swivel; a port connector connectable to the distal end of the second water inlet tube, the port connector having external threads threadingly engaging the port of the boat; and a water inlet conduit having a proximal end engageable with the port connector and a distal end positioned under the bottom portion of the boat.

14 Claims, 11 Drawing Sheets

(51) Int. Cl.
*B63B 17/00* (2006.01)
*B63H 11/00* (2006.01)
*B63B 69/00* (2013.01)

(52) U.S. Cl.
CPC ..... *B63B 69/00* (2013.01); *B63H 11/00* (2013.01); *F41B 9/0018* (2013.01); *F41B 9/0003* (2013.01); *F41B 9/005* (2013.01)

(58) Field of Classification Search
USPC ..... 114/255; 440/39
See application file for complete search history.

(56) References Cited

U.S. PATENT DOCUMENTS

| | | | | |
|---|---|---|---|---|
| 4,074,651 | A * | 2/1978 | Arduser | B63B 35/26 114/255 |
| 5,299,960 | A * | 4/1994 | Day | B63H 11/107 440/39 |
| 6,168,481 | B1 | 1/2001 | Mardikian | |
| 6,192,820 | B1 | 2/2001 | Anderson et al. | |
| 8,851,943 | B2 * | 10/2014 | Zapata | B63H 11/04 440/39 |
| 9,168,991 | B2 * | 10/2015 | Zapata | B63H 11/10 |

OTHER PUBLICATIONS

Sea Fresh Marine, "5.0 GPM Washdown Pump Kit." Retrieved from the Internet at http://www.seaflo.us/product/50gpmwashdownpumpkit/ on Mar. 27, 2017.

* cited by examiner

WATER SPRAY SYSTEM FOR A BOAT

CROSS REFERENCE TO RELATED APPLICATION

This application claims priority to U.S. Provisional Application Ser. No. 62/484,697, filed on Apr. 12, 2017, the entire contents of which are hereby expressly incorporated herein by reference.

BACKGROUND

Water sports using boats are increasingly popular for water sport practitioners. Such water sports may include, for example, water skiing, water tubing, wakesurfing, and wakeboarding. Riders in the boat pulling the water sport practitioner may want to add an additional activity such as the use of a boat spray gun to spray water at the water sport practitioner or others.

However, there are problems encountered when attempting to provide a supply of water to a boat spray gun while the boat is moving. First, boat owners may not want to cut additional holes through the boat to access water for the spray gun. Second, existing ports may be undesirable for accessing the water. For example, current access from the boat to the water may be found through a drain port in the stern of the boat. However, when a boat is in motion, a low pressure region forms behind the boat such that water near the drain port may have negative or zero water pressure, which makes water intake at that location difficult. Third, scoop systems alone do not create enough pressure for effective spray gun use. Therefore, apparatuses and systems are needed to intake water from the outside of the boat for use with a boat spray gun, using existing ports through the boat hull.

BRIEF DESCRIPTION OF THE SEVERAL VIEWS OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function.

DETAILED DESCRIPTION OF EXEMPLARY EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, V, and Z" will be understood to include X alone, V alone, and Z alone, as well as any combination of X, V, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

Finally, as used herein any reference to "one embodiment" or "an embodiment" means that a particular element, feature, structure, or characteristic described in connection with the embodiment is included in at least one embodiment, and may be included in multiple embodiments, unless stated otherwise. The appearances of the phrase "in one embodiment" in various places in the specification are not necessarily all referring to the same embodiment.

Figure 1:
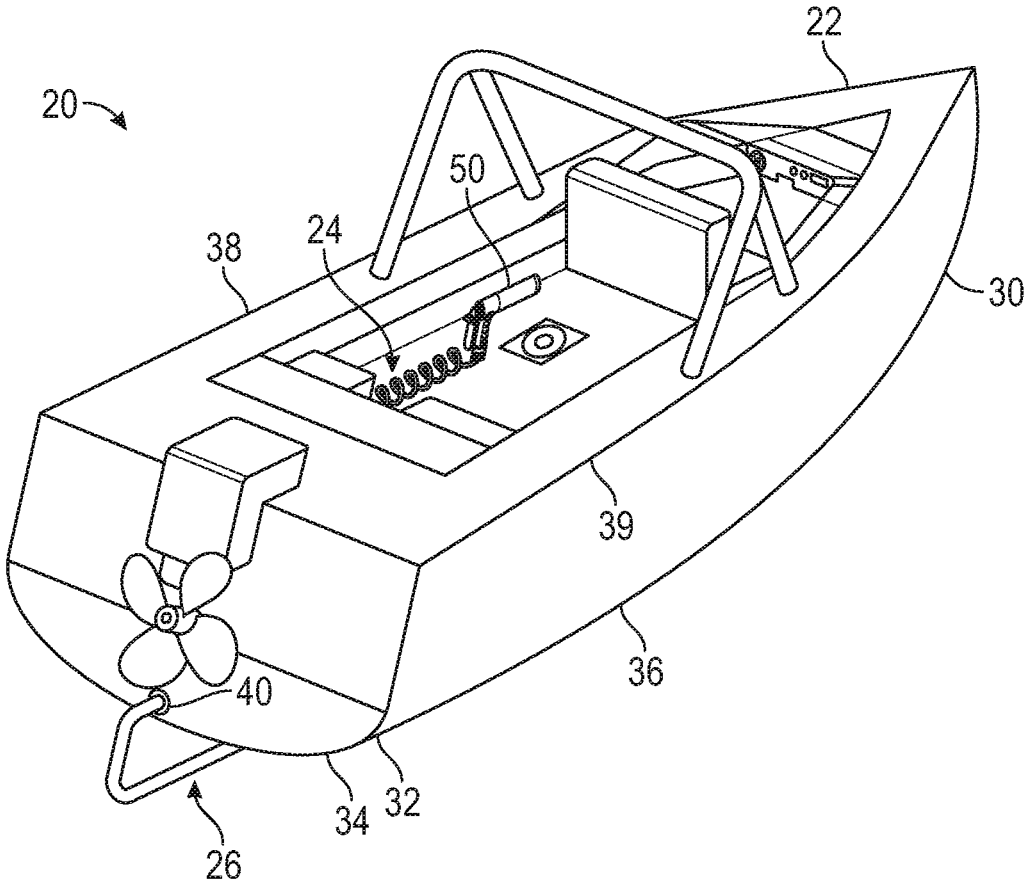
FIG. 1 is a perspective view of an exemplary embodiment of a water spray system for a boat in accordance with the present disclosure.
Figure 2:
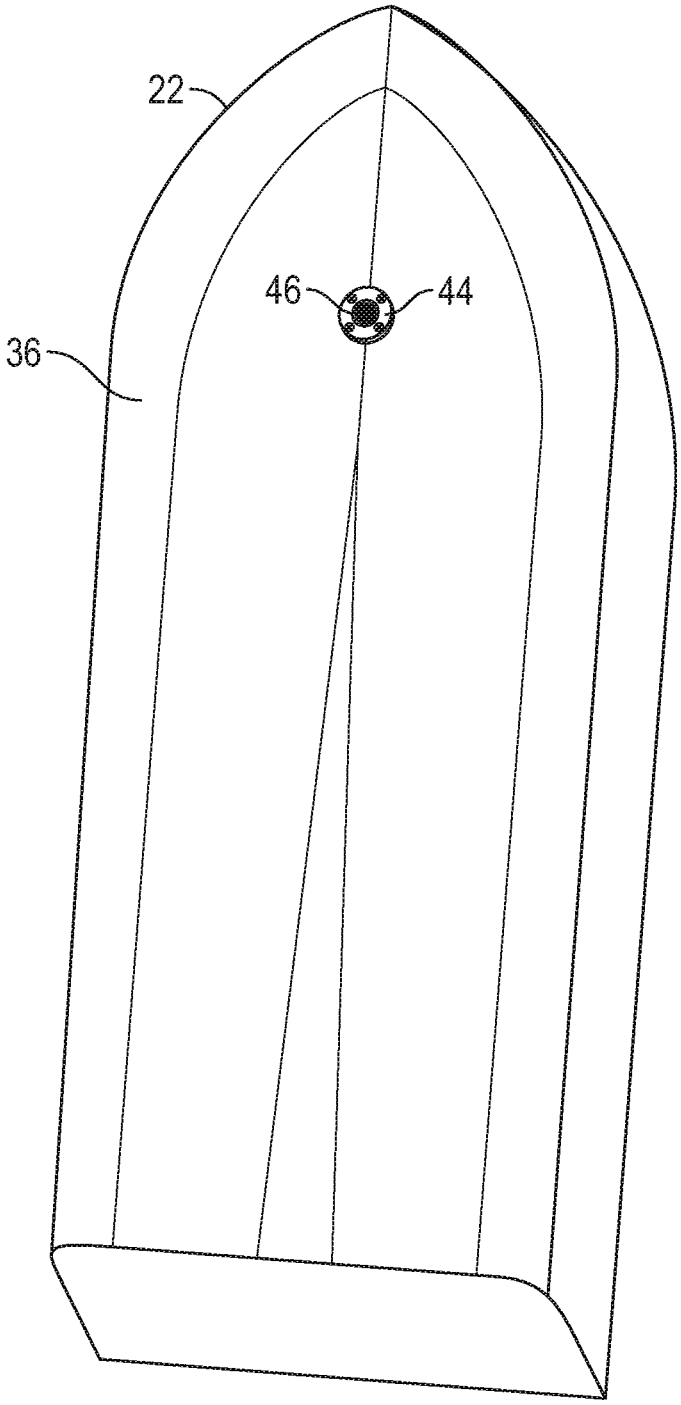
FIG. 2 is a bottom view of the system and boat of FIG. 1.
Figure 3:
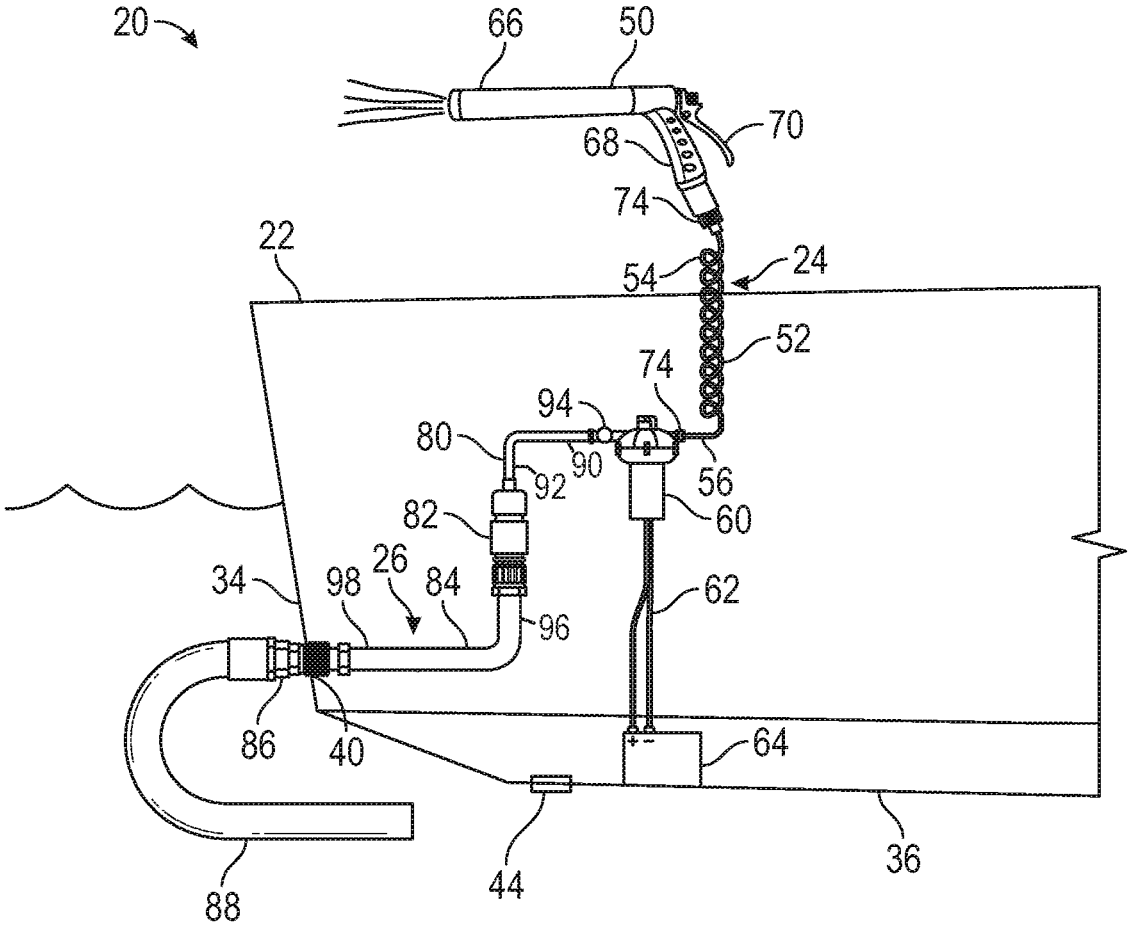
FIG. 3 is a partial cross-sectional view of the system of FIG. 1.

Referring now to the drawings, FIGS. 1-3 illustrate an exemplary embodiment of a boat water spray system 20, comprising a boat 22, a spray gun system 24, and a water intake system 26, in accordance with the present disclosure.

The boat 22 has a forward section 30 and an aft section 32. The aft section 32 may have a transom 34. The boat 22 has a bottom portion 36 extending from the forward section 30 to the transom 34. The boat 22 has a vertical plane of symmetry which divides the boat 22 into a port portion 38 and a starboard portion 39. One or more portion of the transom 34 may be perpendicular to the plane of symmetry of the boat 22. In some embodiments, one or more portions of the transom 34 may be constructed to have an angle from the bottom portion 36 of the boat 22. As a nonexclusive example, the angle of the transom 34 may range between about eighty degrees and about one hundred degrees in relation to the bottom portion 36 of the boat 22.

In one embodiment, the boat 22 may have one or more stern port 40 through the transom 34. The stern port 40 may be positioned proximate to the bottom portion 36 of the boat 22 in the transom 34. In some embodiments, the stern port 40 may have internal threads 42 that are sized to ½ inch National Pipe Taper (NPT), as defined by the American National Standard Taper Pipe Thread American National Standards Institute—American Society of Mechanical Engineers standard B1.20.1. In some embodiments, the stern port 40 may have internal threads 42 that are sized to ¾ inch National Pipe Taper (NPT), as defined by the American National Standard Taper Pipe Thread American National Standards Institute—American Society of Mechanical Engineers standard B1.20.1. In some embodiments, the stern port 40 may be below the water line (that is, the level to which water rises around the boat 22) when the boat 22 is placed in a body of water.

Additionally, or alternately, the boat 22 may have one or more threaded bottom ports 44 through the bottom portion 36 of the boat 22. In some embodiments, the bottom port may have internal threads 46 that are sized to ½ inch National Pipe Taper (NPT), as defined by the American National Standard Taper Pipe Thread American National Standards Institute—American Society of Mechanical Engineers standard B1.20.1. In some embodiments, the bottom port may have internal threads 46 that are sized to ¾ inch National Pipe Taper (NPT), as defined by the American National Standard Taper Pipe Thread American National Standards Institute—American Society of Mechanical Engineers standard B1.20.1. The bottom port 44 may be below the water line when the boat 22 is placed in a body of water.

The boat 22 may have one or more plugs 48 (FIG. 17) for use in the stern port(s) 40 and/or the bottom port(s) 44. The plug 48 may be sized to fit the port stern port(s) 40 and/or the bottom port(s) 44 to prevent the passage of water through the port stern port(s) 40 and/or the bottom port(s) 44 when the plug 48 is engaged with the port stern port(s) 40 and/or the bottom port(s) 44.

As shown in FIG. 3, in one embodiment, the spray gun system 24, may comprise a spray gun 50; a spray gun water entry tube 52 having a proximal end 54 and a distal end 56, the proximal end 54 connectable to the spray gun 50; and a pump 60 connectable to the distal end 56 of the spray gun water entry tube 52. The spray gun system 24 may further comprise an electrical connection 62, such as electrical leads, from the pump 60 to a power source 64. The power source 64 may be a battery, for example, and/or may be part of an electrical system (not shown) of the boat 22.

In one embodiment, the spray gun 50 may have a discharge tube 66, a handle 68, and a trigger 70. The movement of the trigger 70 may restrict, cut off, or allow water to flow through the discharge tube 66. The discharge tube 66 may direct the flow of water through the spray gun 50. The trigger 70 may control the amount of water flowing through the discharge tube 66, thus controlling in part the distance the water sprays from the discharge tube 66.

In one embodiment, the spray gun water entry tube 52 may be connectable to the spray gun 50 and/or to the pump 60 with one or more quick-connect connectors 74. The spray gun water entry tube 52 may be a coiled hose or tube that allows for longitudinal retraction and expansion.

In one embodiment, the pump 60 may be sized to pull water through the water intake system 26 and provide the spray gun 50 with water pressure sufficient to discharge a stream of water a distance of between twenty and fifty feet. In one embodiment, the pump 60 may be sized to pull water through the water intake system 26 and provide the spray gun 50 with water pressure sufficient to discharge a stream of water a distance of at least fifty feet. In one embodiment, the pump 60 may be a twelve volt water pump. In one embodiment, the pump 60 may be capable of up to between approximately sixty and eighty pounds per square inch of pressure. In one embodiment, the pump 60 may be capable of approximately seventy pounds per square inch of pressure.

In one embodiment, the water intake system 26 comprises one or more water inlet tubes, such as a first water inlet tube 80 and/or a second water inlet tube 84, a port connector 86, and a water inlet conduit 88. In one embodiment, the water intake system 26 further comprises a swivel 82.

The first water inlet tube 80 may have a proximal end 90 connectable to the pump 60 of the spray gun system 24 and a distal end 92. In one embodiment, the water intake system 26 further comprises a water filter 94. The water filter 94 may be positioned between the first water inlet tube 80 and the pump 60 of the spray gun system 24, or elsewhere within the water intake system 26 such that water is filtered before it enters the pump 60.

In one embodiment, the swivel 82 is connectable to the distal end 92 of the first water inlet tube 80. The swivel 82 may be a coupling between the first water inlet tube 80 and the second water inlet tube 84 that enables one to revolve without turning the other.

The second water inlet tube 84 may have a proximal end 96 and a distal end 98, the proximal end 96 connectable to the swivel 82 or to the first water inlet tube 80.

Figure 4:
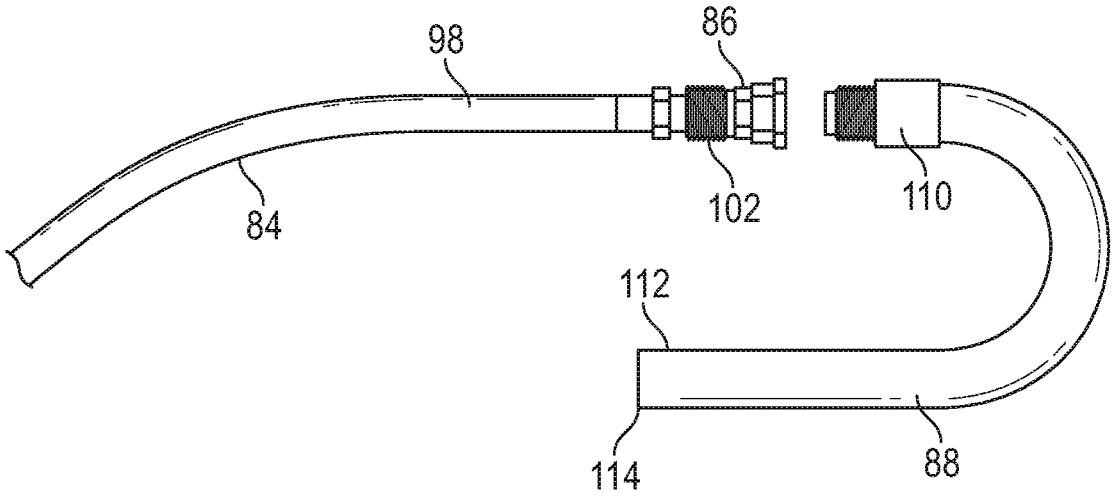
FIG. 4 is an elevational view of components of an exemplary embodiment water spray system for a boat in accordance with the present disclosure.
Figure 5:
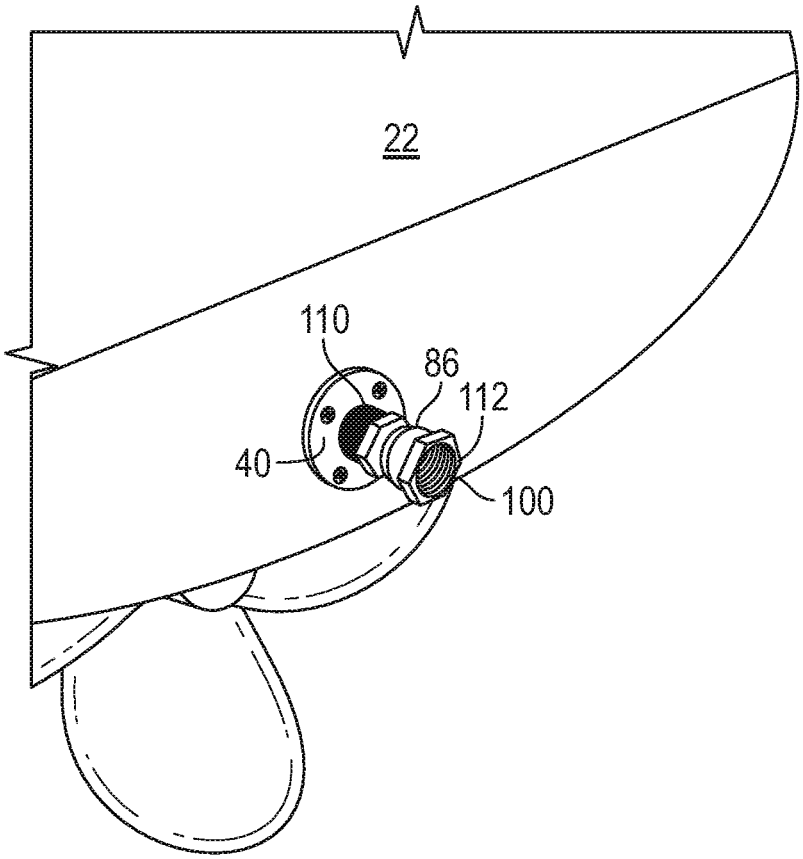
FIG. 5 is a partial perspective view of components of an exemplary water spray system for a boat in accordance with the present disclosure.
Figure 6:
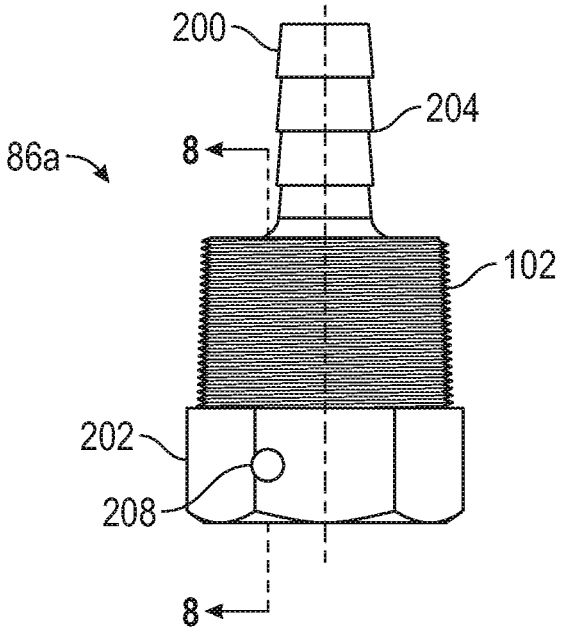
FIG. 6 is an elevational view of a component of an exemplary embodiment of a water spray system for a boat in accordance with the present disclosure.
Figure 7:
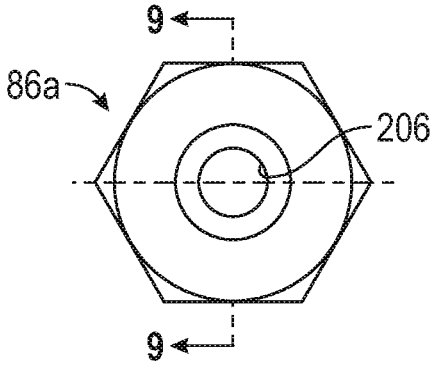
FIG. 7 is a front view of the component of FIG. 6.
Figure 8:
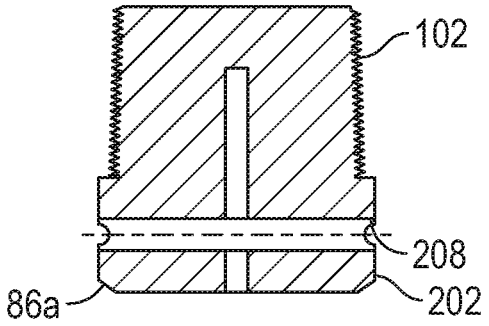
FIG. 8 is a cross-sectional view of the component of FIG. 7.
Figure 9:
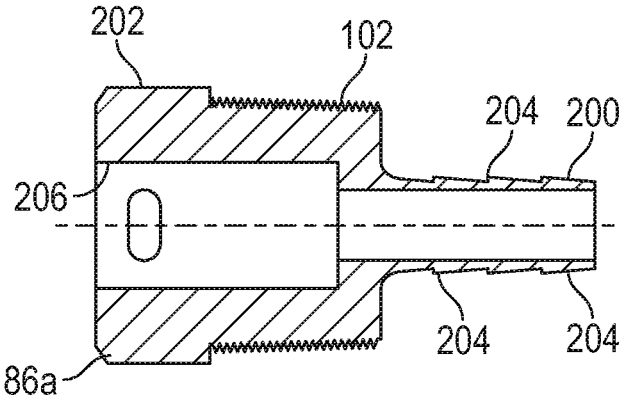
FIG. 9 is a cross-sectional view of the component of FIG. 6.
Figure 10:
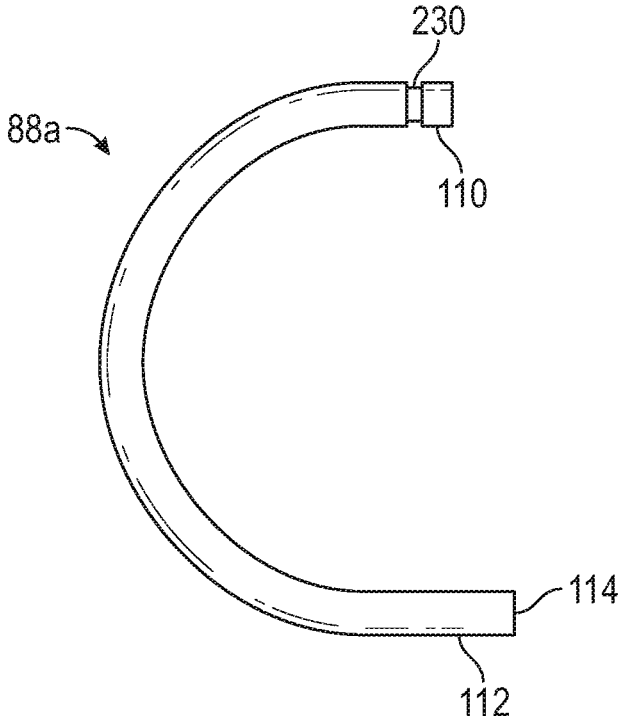
FIG. 10 is an elevational view of a component of an exemplary embodiment of a water spray system for a boat in accordance with the present disclosure.
Figure 11:
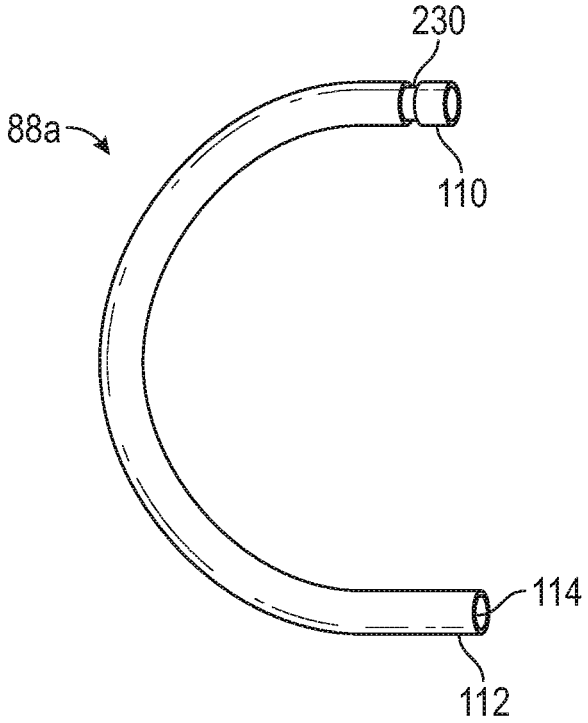
FIG. 11 is a perspective view of the component of FIG. 10.
Figure 12:
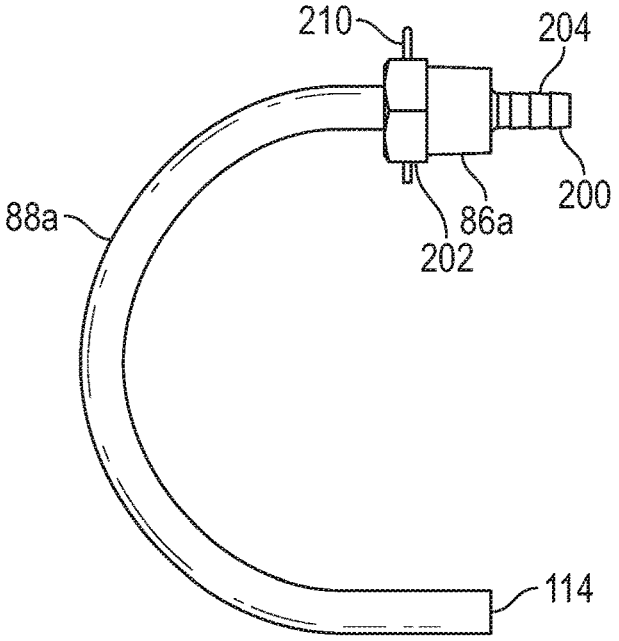
FIG. 12 is an elevational view of components of an exemplary embodiment of a water spray system for a boat in accordance with the present disclosure.
Figure 13:
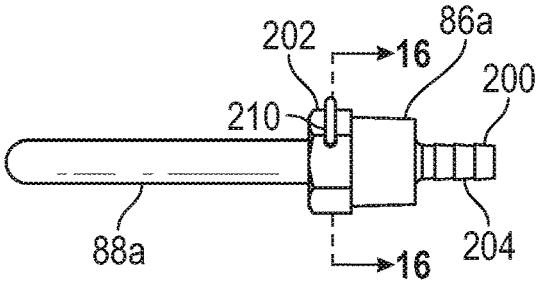
FIG. 13 is a top plan view of the components of FIG. 12.

As shown in FIGS. 3-5, for example, the port connector 86 is connectable to the distal end 98 of the second water inlet tube 84. In one embodiment, the port connector 86 may have internal threads 100, as shown in FIG. 5.

FIGS. 6-9 illustrate another embodiment of the port connector 86*a* constructed in accordance with the inventive concepts disclosed herein. The port connector 86*a* has a first end portion 200 and a second end portion 202. The port connector 86*a* may have one or more flanges 204 extending from the outside of the first end portion 200. The flanges 204 may be sized to engage with the interior of the distal end 98 of the second water inlet tube 84 to connect the port connector 86*a* and the second water inlet tube 84. The port connector 86*a* has a channel 206 having an internal diameter extending through the port connector 86*a* from the first end portion 200 through the second end portion 202 to allow water to flow through the port connector 86*a*. The port connector 86*a* may have a through hole 208 extending across a width of the second end portion 202 and at least a portion of the internal diameter of the channel 206 of the port connector 86*a*. The through hole 208 may be sized to accept a pin connector 210 (see FIGS. 12-16).

In one embodiment, the port connector 86, 86*a* may have a lip or connector at one or both ends. The port connector 86, 86*a* and may be connectable to other components with a quick-disconnect, snap-disconnect, or other connection device. In one embodiment, the port connector 86, 86*a* may have one or more rubber compression seal (not shown). The rubber compression seal may be used to connect the port connector to the stern port(s) 40 and/or the bottom port(s) 44.

In some embodiments, the port connector 86, 86*a* may have external threads 102 for threadingly engaging the stern port 40 or the bottom port 44 of the boat 22. In some embodiments, the external threads 102 of the port connector 86, 86*a* are sized to ½ inch National Pipe Taper (NPT), as defined by the American National Standard Taper Pipe Thread American National Standards Institute—American Society of Mechanical Engineers standard B1.20.1. In some embodiments, the external threads 102 of the port connector 86, 86*a* are sized to ¾ inch National Pipe Taper (NPT), as defined by the American National Standard Taper Pipe Thread American National Standards Institute—American Society of Mechanical Engineers standard B1.20.1. It will be understood that the external threads 102 may have other sizes and/or shapes in order to engage the threads 46 of the stern port(s) 40 and/or the bottom port(s) 44.

Returning now to FIGS. 3 and 4, the water inlet conduit 88 may have a proximal end 110 connectable with the port connector 86, 86*a*, and a distal end 112 positioned even with, or under, the bottom portion 36 of the boat 22, such that the distal end 112 is in a neutral or a positive pressure area of the water when the boat 22 is moving through the water. In one embodiment, the distal end 112 of the water inlet conduit 88 is positioned under the bottom portion 36 of the boat 22 between the forward section 30 and the transom 34 of the boat 22.

In one embodiment, the proximal end 110 of the water inlet conduit 88 may be threadingly engageable with the internal threads 100 of the port connector 86. In one embodiment, the water inlet conduit 88 may be connectable with the port connector 86, 86*a* with a quick-disconnect, snap-disconnect, rubber compression seal(s), or other connection device, which are well known to those having skill in the art.

FIGS. 10-16 illustrate another embodiment of a water inlet conduit 88*a* constructed in accordance with the inventive concepts disclosed herein. In one embodiment, the proximal end 110 of the water inlet conduit 88*a* may have one or more grooves 230 around the outer diameter of the water inlet conduit 88*a*. The one or more grooves 230 may be sized to accept at least a portion of the pin connector 210.

Figure 14:
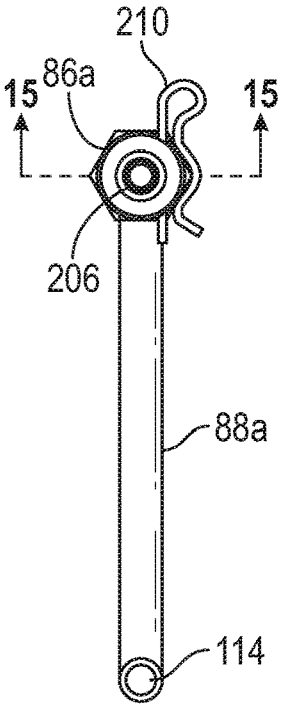
FIG. 14 is a rear view of the components of FIG. 12.
Figure 15:
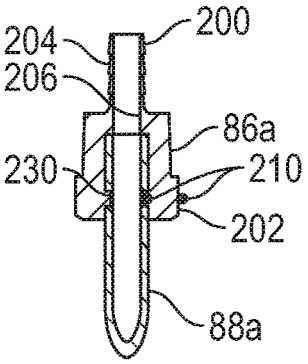
FIG. 15 is a cross-sectional view of the components of FIG. 14.
Figure 16:
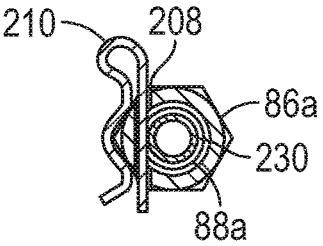
FIG. 16 is a cross-sectional view of the components of FIG. 13.

The pin connector 210 may be used to secure and/or connect the water inlet conduit 88*a* to the port connector 86*a*. The pin connector 210 may be made of metal, or any suitable material or combination of materials having sufficient strength to secure the port connector 86*a* and the water inlet conduit 88. In one embodiment, nonexclusive examples of the pin connector 210 include a hairpin, cotter pin, and a linchpin. The pin connector 210 may be positioned through the through hole 208 of the port connector 86*a* after the water inlet conduit 88*a* is inserted in the port connector 86*a*, such that the pin connector 210 is also positioned at least partially within the groove 230 of the water inlet conduit 88*a*, thereby securing the water inlet conduit within the port connector, as illustrated in FIGS. 14-16.

In one embodiment, the proximal end 110 of the water inlet conduit 88*a* may be rotatably connectable to the port connector 86*a*, for example, such that the water inlet conduit 88*a* may swivel in the port connector 86*a*. For example, the groove 230 may allow the pin connector 210 to remain in place when the water inlet conduit 88*a* is rotated within the port connector 86*a*, while maintaining the connection between the water inlet conduit 88*a* and the port connector 86*a*.

In one embodiment, the water inlet conduit 88, 88*a* is "u" shaped. In one embodiment, the water inlet conduit is "j" shaped. It will be understood that the water inlet conduit 88, 88*a* may be other shapes as long as the water inlet conduit 88 reaches from the stern port 40 to a position such that the distal end 112 is in a neutral or a positive pressure area of the water when the boat 22 is moving through the water, such as even with the bottom portion 36 of the boat, or under the bottom portion 36 of the boat 22, or under the bottom portion 36 of the boat 22 between the forward section 30 and the transom 34 of the boat 22. In one embodiment, the distal end of the water inlet conduit 88, 88*a* may be positioned under the bottom portion 36 of the boat 22 and behind the boat 22.

Non-exclusive examples of the water inlet conduit 88, 88*a* may include a cylinder, a tube, a pipe, and a scoop. The water inlet conduit 88, 88*a* may be formed from a single piece. The water inlet conduit 88, 88*a* may be formed from multiple components, sections, and/or connections. The water inlet conduit 88, 88*a* may be formed from any suitable material or combinations of materials, non-exclusive examples of which include metal, polymer, and rubber. In some embodiments, the water inlet conduit 88, 88*a* may be formed, at least in part, of stainless steel.

In one embodiment, one or more seal or sealing material may be used between and/or around any of the components. As a non-exclusive example, a seal, such as an o-ring, may be used between the water inlet conduit 88, 88*a* and the port connector 86, 86*a*.

In one embodiment, the distal end 112 of the water inlet conduit 88, 88*a* has an opening 114. In one embodiment, the opening 114 bay be aligned to face the forward section 30 of the boat 22. In one embodiment, the opening 114 may be aligned downward, for example, approximately perpendicular to the bottom portion 36 of the boat 22.

In one embodiment, the opening 114 may be the size of the internal diameter of the water inlet conduit 88, 88*a*. In one embodiment, the opening 114 may be smaller than the internal diameter of the water inlet conduit 88, 88*a*. In one embodiment, the opening 114 may be larger than the internal diameter of the water inlet conduit 88, 88*a*, such as if the opening 114 is on a bias in relation to the water inlet conduit 88, 88*a*.

In one embodiment, the water inlet conduit 88, 88*a* may be a pipe with an internal diameter of approximately ¾ inch. In one embodiment, the water inlet conduit 88, 88*a* may be a pipe with an internal diameter of approximately ½ inch. In one embodiment, the water inlet conduit 88, 88*a* may have an internal diameter of approximately ⅜ inch. It will be understood that the water inlet conduit 88, 88*a* may have an internal diameter of any size sufficient to allow water to enter the water intake system 26 and supply the spray gun system 24 through the pump 60. The size of the internal diameter of the water inlet conduit 88, 88*a* may be proportionately related to the power of the pump 60.

It will be understood that one or more of the spray gun water entry tube 52, the first water inlet tube 80, the swivel 82, the second water inlet tube 84, the port connector 86, 86*a*, and the water inlet conduit 88, 88*a*, may be made of one piece, two pieces, or more than two pieces. Additionally, it will be understood that one or more connectors may be used to connect components or pieces of components. The connectors may be threaded, may snap to connect to one another, may use compression, or may be of other connector types, which are well known to those having skill in the art.

Figure 21:
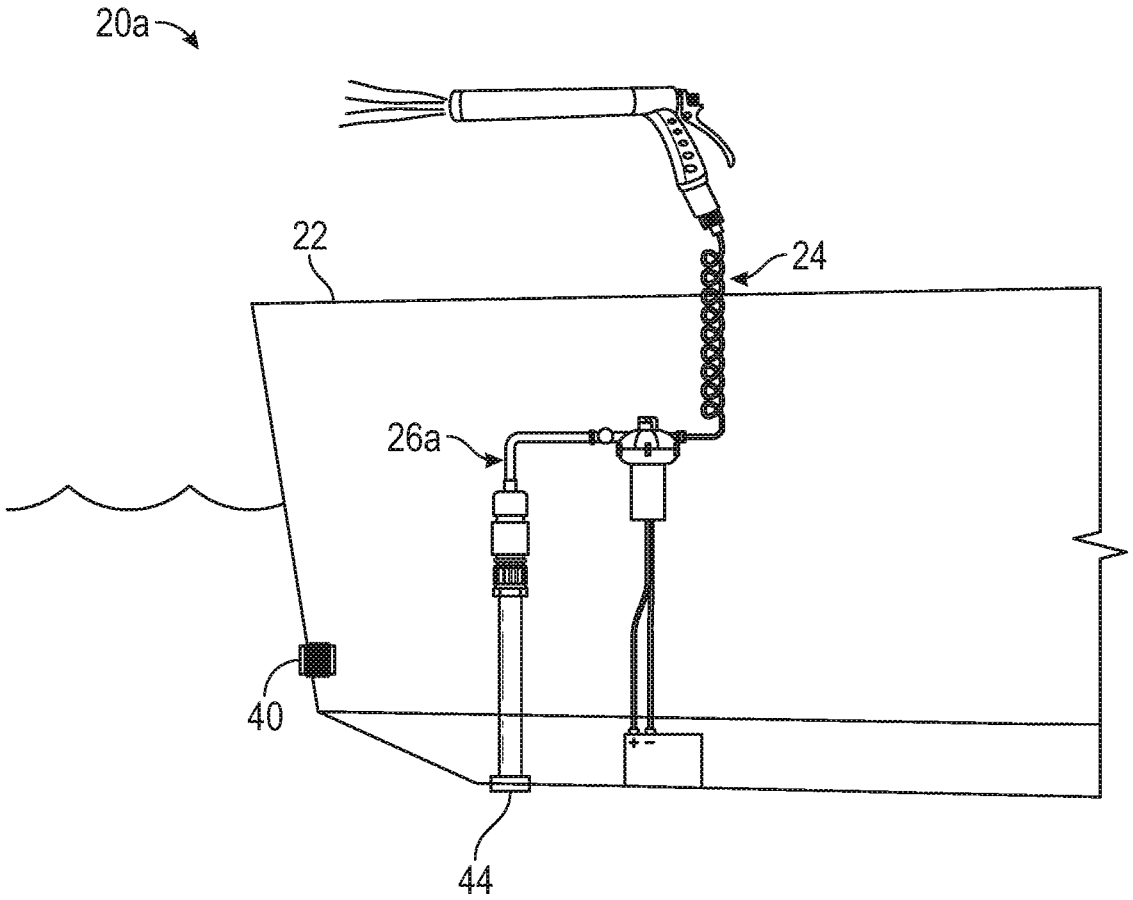
FIG. 21 is a partial cross-sectional view of another exemplary embodiment of a water spray system for a boat in accordance with the present disclosure.

FIG. 21 illustrates another embodiment of the boat water spray system 20*a* constructed in accordance with the inventive concepts disclosed herein. The boat water spray system 20*a* is substantially similar to the boat water spray system 20, except, as shown in FIG. 21, the water intake system 26*a* may be connectable to the bottom port 44 with or without the water inlet conduit 88, 88*a*.

Figure 22:
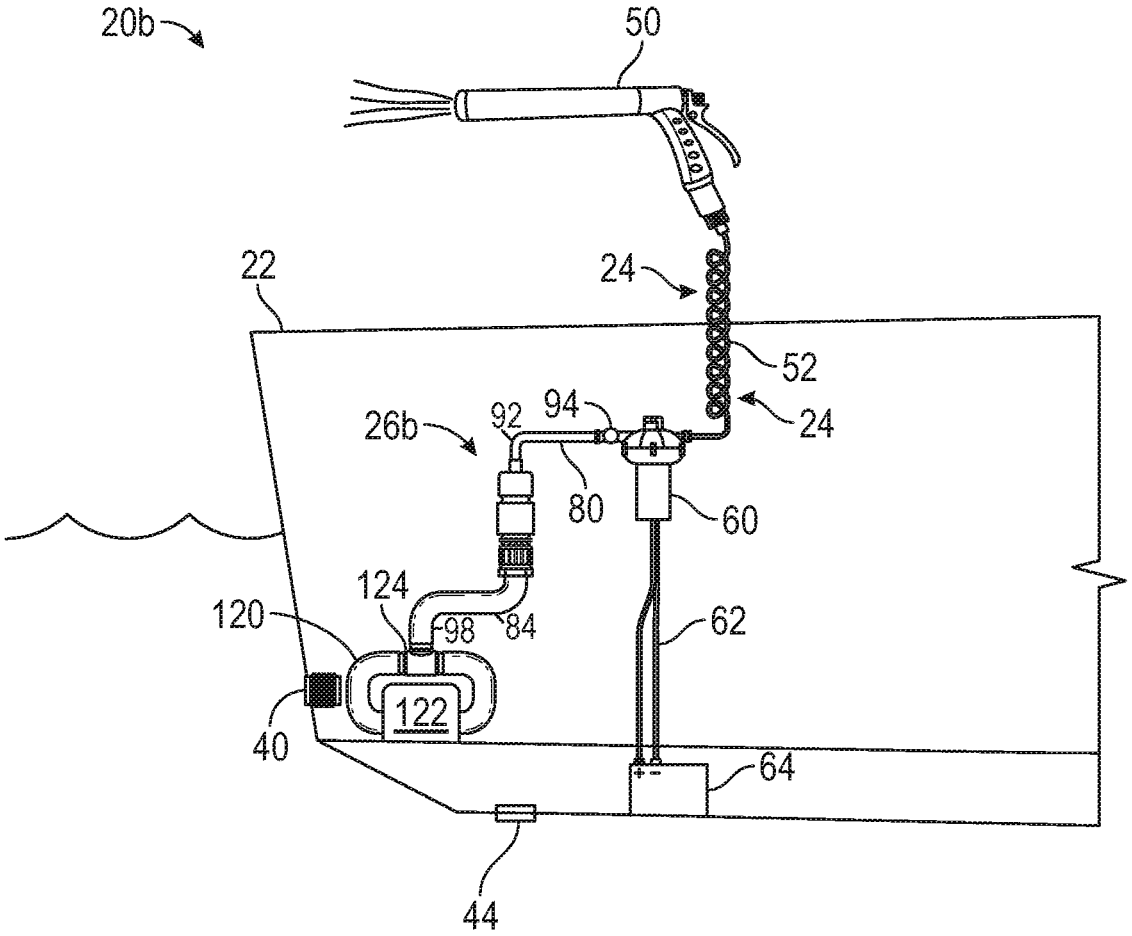
FIG. 22 is a partial cross-sectional view of another exemplary embodiment of a water spray system for a boat in accordance with the present disclosure.
Figure 23:
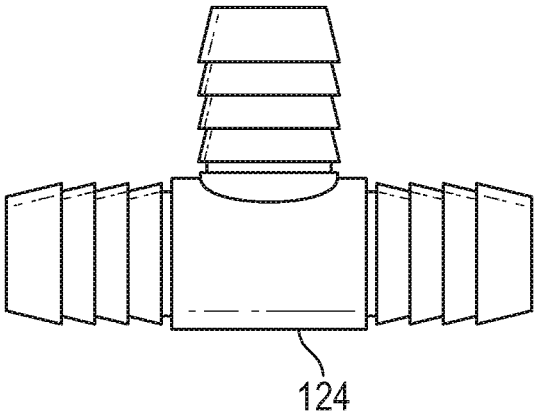
FIG. 23 is an elevational view of a component of the system of FIG. 22.

FIGS. 22 and 23 illustrate another embodiment of the boat water spray system 20*b* constructed in accordance with the inventive concepts disclosed herein. The boat water spray system 20*b* is substantially similar to the boat water spray system 20, except as described herein below. The boat water spray system 20*b* may comprise the boat 22 having a pre-existing water hose 120 such as the water hose 120 attached to one or more mechanical components 122 of the boat 22, such as in an existing water circulation system and/or existing water-based motor cooling system and/or other mechanical components 122 of the boat 22 that utilize water. One non-exclusive example of the water hose 120 is a water hose for a boat motor or boat manifold.

The boat water spray system 20*b* may further comprise the spray gun system 24 and a water intake system 26*b*. In one embodiment, the water intake system 26*b* may comprise the first water inlet tube 80 having the proximal end 90 connectable to the pump 60 of the spray gun system 24, the swivel 82, the second water inlet tube 84, and a water-system connector 124. In one embodiment, the water intake system 26*b* may comprise the first water inlet tube 80 having the proximal end 90 connectable to the pump 60 of the spray gun system 24 and a water-system connector 124 (without the second water inlet tube and/or the swivel).

In one embodiment, the water-system connector 124 may be a pipe tee. The water-system connector 124 may be a T-shaped fitting (such as a three-way tube) connectable to three lengths of pipe/hose in the same plane, wherein one length of the water-system connector 124 is at an angle (such as a ninety degree angle or other angle) to the other two lengths of the water-system connector 124. The water-system connector 124 may be connectable to two sections of the water hose 120 and the distal end 98 of the second water inlet tube 84. In one embodiment, the water-system connector 124 may be connectable to two sections of the water hose 120 and the distal end 92 of the first water inlet tube 80, such that the second water inlet tube 84 and the swivel 82 are not used.

In the installation of the boat water spray system 20*b*, an installer may cut the water hose 120, insert the water-system connector 124 between the two cut sections of the water hose 120, and connect the distal end 92 of the first water inlet tube 80 or the distal end 98 of the second water inlet tube 84 to the water-system connector 124. In use, the pump 60 may pull water from the water hose 120 and/or the mechanical components 122 of the boat 22, such as in an existing water circulation system, to provide water to the spray gun system 24.

Referring now to FIGS. 1-20, an example of one embodiment of the boat water spray system 20 in use in accordance with the present disclosure will be described. No particular order of the steps is required, except where specified.

Figure 17:
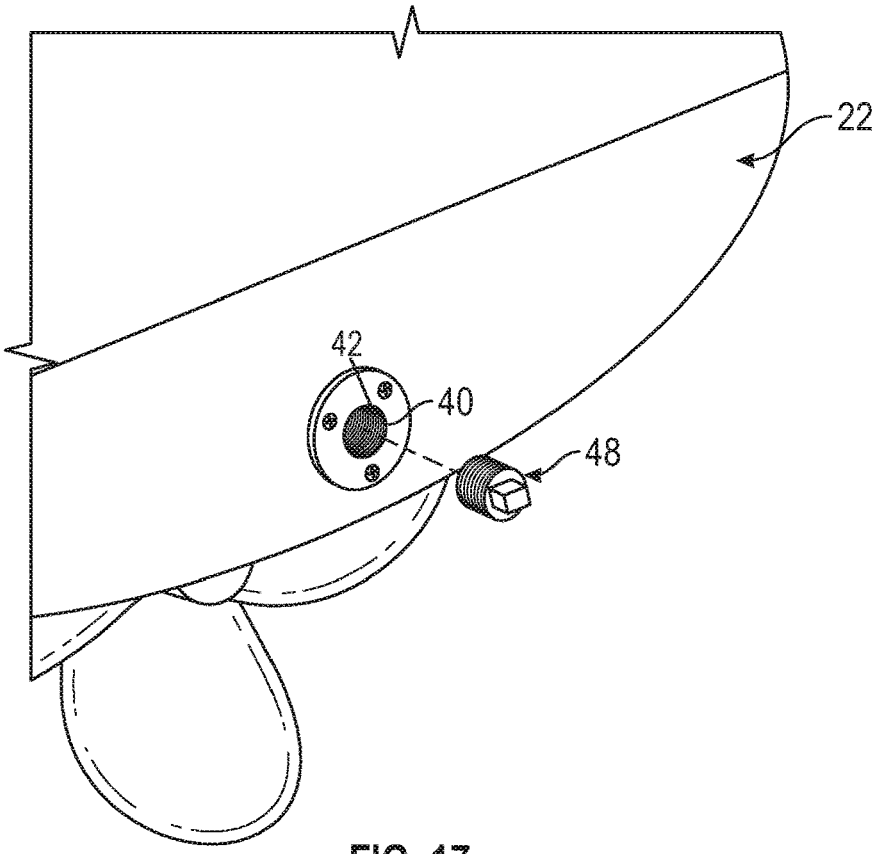
FIG. 17 is a partial perspective rear view of components of an exemplary embodiment of a water spray system for a boat in accordance with the present disclosure.

In one embodiment, an installer may remove the port plug 48 from the stern port 40, if the port plug is in place in the stern port 40 (see FIG. 17). The installer may insert the second water inlet tube 84 through the stern port 40 (see FIG. 18) into, or out of, the boat 22. The installer may connect the distal end 98 of the second water inlet tube 84 to the port connector 86, 86*a*. In one embodiment, the installer may connect the distal end of 98 of the second water inlet tube 84 to the port connector 86*a*, by placing the second water inlet tube 84 over the flanges 204 of the port connector 86*a*. The installer may engage the external threads 102 of the port connector 86, 86*a* with the threads 42 of the stern port 40, and/or may engage other types of connectors between the stern port 40 and the port connector 86, 86*a*.

The installer may connect the swivel 82 to the second water inlet tube 84. The installer may connect first water inlet tube 80 to the swivel 82 and the pump 60. In one embodiment, the installer may install the filter 94 between the port connector 86 and the pump 60, such as between the first water inlet tube 80 and the pump 60.

The installer may connect the spray gun water entry tube 52 to the pump 60. The installer may connect the spray gun 50 to the spray gun water entry tube 52, such as with a quick-connect connector 74. The pump 60 is electrically connected to the power source 64, such as a battery.

The boat 22 may have a deck (not shown) and one or more of the first and second water inlet tubes 80, 84, the swivel 82, the pump 60, the electrical connection 62, and the power source 64, may be positioned beneath the deck of the boat 22, for safety and convenience.

The installer may connect the proximal end 110 of the water inlet conduit 88, 88*a* to the port connector 86, 86*a* on the exterior of the boat 22. In one embodiment, the installer may threadingly engage the water inlet conduit 88 with the threads 100 of the port connector 86. In one embodiment, the installer may insert the proximal end 110 of the water inlet conduit 88*a* into the second end portion 202 of the port connector 86*a*. The installer may insert the pin connector 210 in the through hole 208 of the port connector 86*a*, positioning the pin connector 210 in the groove 230 of the water inlet conduit 88*a*.

Figure 19:
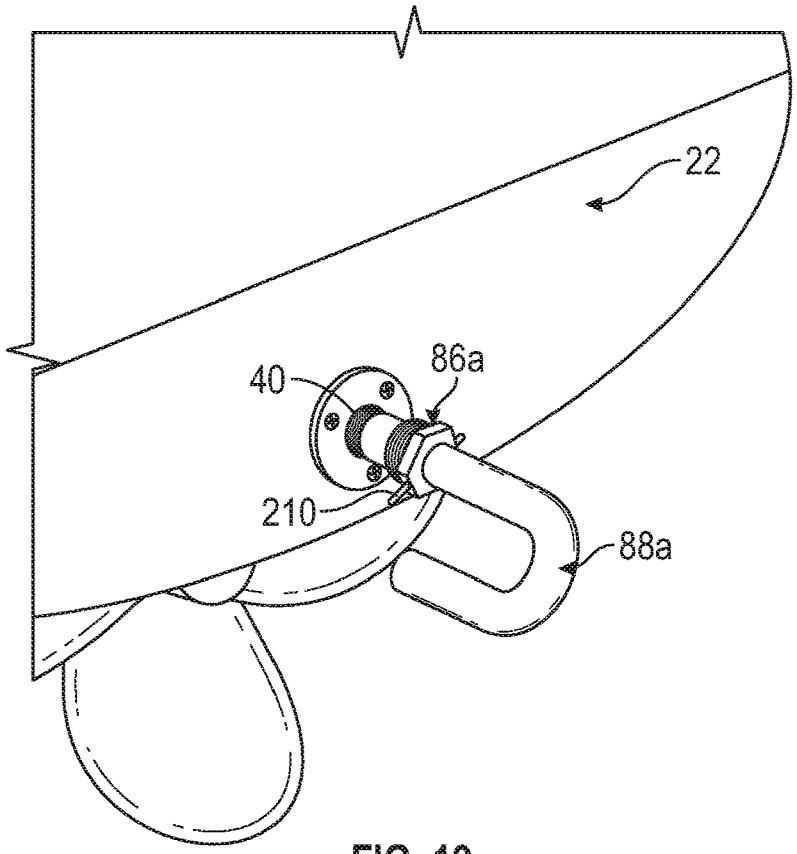
FIG. 19 is a partial rear perspective view of components of an exemplary embodiment of a water spray system for a boat in accordance with the present disclosure.
Figure 20:
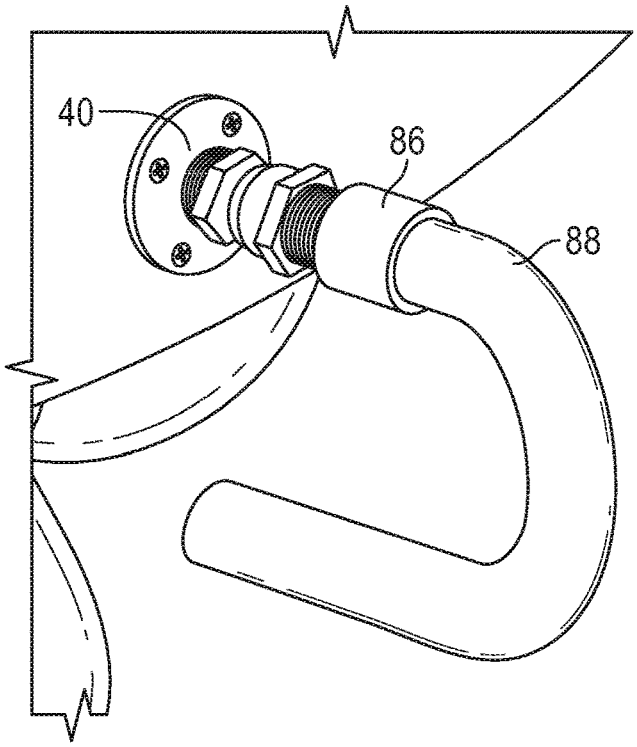
FIG. 20 is a partial rear perspective view of components of an exemplary embodiment of a water spray system for a boat in accordance with the present disclosure.

The installer may position the distal end 112 of the water inlet conduit 88, 88*a* under the aft section 32 of the boat 22, as shown in FIGS. 19 and 20. In one embodiment, the installer may position the distal end 112 of the water inlet conduit 88, 88*a* under the aft section 32 of the boat 22 between the transom 34 and the forward section 30, with the opening 114 of the water inlet conduit 88 facing the forward section 30.

In use, as the boat 22 moves through water, a negative pressure area is formed in the water directly behind the aft section 32 of the boat 22 near the stern port 40. The distal end 112 of the water inlet conduit 88 extends beyond the negative pressure area into an area under the boat 22 such that the pump 60 pulls water from a neutral or positive pressure area through the water inlet conduit 88, 88*a*, through the port connector 86, 86*a*, the second water inlet tube 84, the swivel 82, the first water inlet tube 80, and the filter 94 (when applicable). The pump 60 dispenses the water through the spray gun water entry tube 52 to the spray gun 50.

The user activates the trigger 70 to discharge the water through the discharge tube 66. The user can aim and discharge water from the spray gun 50. In the embodiment where the spray gun water entry tube 52 is flexibly coiled, the user can expand or contract the spray gun water entry tube 52.

Additionally, when the boat 22 is stopped in the water, the pump 60 can pull water from a neutral or positive pressure area through the water intake system 26 to the spray gun 50. Further, the pump 60 can be used as a stop, to prevent water from moving further into the system 20 or the boat 22.

After the boat 22 is pulled out of the water, the user may disconnect the water inlet conduit 88, 88*a* from the port connector 86, 86*a*. The user may disconnect the port connector 86, 86*a* from the stern port 40 or the bottom port 44. In embodiments with the swivel 82, the swivel 82 allows the second water inlet tube 84 to rotate during disconnection of the port connector 86, 86*a* from the stern port 40 or the bottom port 44, without rotating the first water inlet tube 80 or the spray gun system 24.

Figure 18:
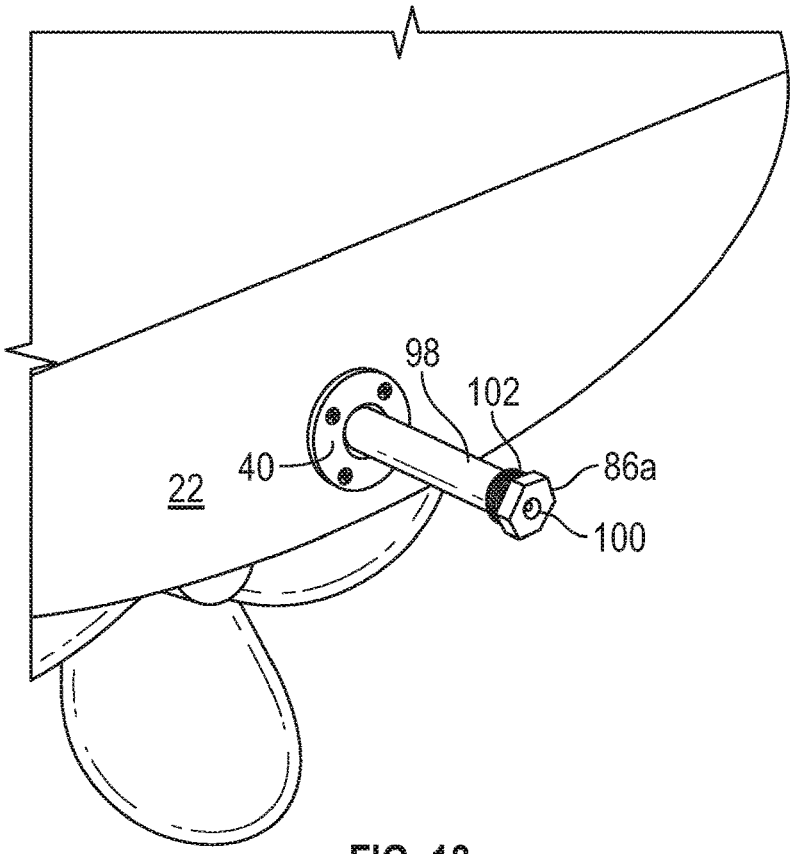
FIG. 18 is another partial perspective rear view of components of an exemplary embodiment of a water spray system for a boat in accordance with the present disclosure.

Once disconnected, the user may pull the port connector 86, 86*a* from the stern port 40 such that part of the second water inlet tube 84 extends outside of the boat 22, as shown in FIG. 18. This allows the stern port 40 to be used to drain water from the boat 22, the water draining out of the stern port 40 around the second water inlet tube 84.

In one embodiment, the user may disconnect the water inlet conduit 88 from the port connector 86 by disengaging the threads 100. In one embodiment, the user may disconnect the water inlet conduit 88*a* from the port connector 86*a* by removing the pin connector 210.

While several embodiments of the inventive concepts have been described for purposes of this disclosure, it will be understood that numerous changes may be made which will readily suggest themselves to those skilled in the art and which are accomplished within the spirit of the inventive concepts disclosed and as defined in the appended claims.

The foregoing description provides illustration and description, but is not intended to be exhaustive or to limit the inventive concepts to the precise form disclosed. Modifications and variations are possible in light of the above teachings or may be acquired from practice of the methodologies set forth in the present disclosure.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

No element, act, or instruction used in the present application should be construed as critical or essential to the invention unless explicitly described as such outside of the preferred embodiment.

What is claimed is:

1. A water intake system, comprising:

a water inlet tube having a distal end and having a proximal end connectable to a pump of a spray gun system, the spray gun system further comprising a spray gun and a spray gun water entry tube having a proximal end connectable to the spray gun and a distal end connectable to the pump;

a port connector connectable to the distal end of the water inlet tube and engaging a port of a boat having a hull with a forward section, an aft section with a transom, a bottom portion extending from the forward section to the transom, and a port through the transom, the port positioned proximate to the bottom portion; and a water inlet conduit having a proximal end engageable with the port connector and a distal end positioned under the bottom portion of the boat between the forward section and the transom of the boat.

2. The water intake system of claim 1, wherein the water inlet tube is a first water inlet tube, and further comprising:

a swivel connectable to the distal end of the first water inlet tube; and a second water inlet tube having a proximal end and a distal end, the proximal end connectable to the swivel, wherein the port connector is connectable to the distal end of the second water inlet tube.

3. The water intake system of claim 1, further comprising a pin connector, and wherein the port connector has an internal diameter, a width, and a through hole across at least a portion of the width and at least a portion of the internal diameter, and wherein the water inlet conduit has a groove in the proximal end, such that when the proximal end of the water inlet conduit is inserted in the internal diameter of the port connector and the pin connector is inserted through the through hole of the port connector, at least a portion of the pin connector is within the groove of the water inlet conduit, thereby securing the water inlet conduit within the port connector.

4. The water intake system of claim 1, wherein the port connector has external threads, threadingly engaging the port of the boat.

5. A boat water spray system, comprising:

a boat having a hull with a forward section, an aft section with a transom, a bottom portion extending from the forward section to the transom, and a port through the transom, the port positioned proximate to the bottom portion;

a spray gun system, comprising:

a spray gun;

a spray gun water entry tube having a proximal end and a distal end, the proximal end connectable to the spray gun; and a pump connectable to the distal end of the spray gun water entry tube; and a water intake system, comprising:

a water inlet tube having a proximal end connectable to the pump of the spray gun system and a distal end;

a port connector engaging the port of the boat and connectable to the distal end of the water inlet tube; and a water inlet conduit having a proximal end engageable with the port connector and a distal end positioned under the bottom portion of the boat between the forward section and the transom of the boat.

6. The boat water spray system of claim 5, where in the water intake system further comprises a pin connector, and wherein the port connector has an internal diameter, a width, and a through hole across at least a portion of the width and at least a portion of the internal diameter, and wherein the water inlet conduit has a groove in the proximal end, such that when the proximal end of the water inlet conduit is inserted in the internal diameter of the port connector and the pin connector is inserted through the through hole of the port connector, at least a portion of the pin connector is within the groove of the water inlet conduit, thereby securing the water inlet conduit within the port connector.

7. The boat water spray system of claim 5, wherein the water inlet tube is a first water inlet tube, and further comprising:

a swivel connectable to the distal end of the first water inlet tube; and a second water inlet tube having a proximal end and a distal end, the proximal end connectable to the swivel, wherein the port connector is connectable to the distal end of the second water inlet tube.

8. The boat water spray system of claim 5, wherein the port connector has external threads threadingly engaging the port of the boat.

9. The boat water spray system of claim 5, wherein the water inlet conduit is j shaped.

10. A water intake system, comprising:

a first water inlet tube having a distal end and having a proximal end connectable to a pump of a spray gun system, the spray gun system further comprising a spray gun and a spray gun water entry tube having a proximal end connectable to the spray gun and a distal end connectable to the pump;

a port connector connectable to the distal end of the first water inlet tube and engaging a port positioned in a bottom portion of a hull of a boat;

a swivel connectable to the distal end of the first water inlet tube; and a second water inlet tube having a proximal end and a distal end, the proximal end connectable to the swivel, wherein the port connector is connectable to the distal end of the second water inlet tube.

11. The water intake system of claim 10, wherein the port connector is threadingly engageable with the port of the boat.

12. The water intake system of claim 10, wherein the port connector has external threads.

13. A boat water spray system, comprising:

a boat having a water hose for carrying water;

a spray gun system, comprising:

a spray gun;

a spray gun water entry tube having a proximal end and a distal end, the proximal end connectable to the spray gun; and a pump connectable to the distal end of the spray gun water entry tube; and a water intake system, comprising:

a water inlet tube having a proximal end connectable to the pump of the spray gun system and a distal end; and a water-system connector comprising a three-way tube connectable to the water hose of the boat and the distal end of the water inlet tube.

14. A water intake system for a spray gun for a boat, comprising:

a first water inlet tube having a proximal end connectable to a pump of a spray gun system and a distal end;

a swivel connectable to the distal end of the first water inlet tube;

a second water inlet tube having a proximal end and a distal end, the proximal end connectable to the swivel;

a port connector connectable to the distal end of the second water inlet tube, the port connector having external threads threadingly engaging a port of a boat, the port positioned through a transom of the boat and proximate to a bottom portion of the boat; and a water inlet conduit having a proximal end engageable with the port connector and a distal end positioned under the bottom portion of the boat between a forward section of the boat and the transom of the boat.

* * * * *